United States Patent [19]

Kleber et al.

[11] 4,428,846

[45] Jan. 31, 1984

[54] DRESSING AGENTS FOR SYNTHETIC FIBERS AND THEIR USE

[75] Inventors: Rolf Kleber, Neu-Isenburg; Dieter Plabst, Altötting, both of Fed. Rep. of Germany

[73] Assignee: Hoechst Aktiengesellschaft, Fed. Rep. of Germany

[21] Appl. No.: 283,721

[22] Filed: Jul. 15, 1981

[30] Foreign Application Priority Data

Jul. 24, 1980 [DE] Fed. Rep. of Germany ..... 3028016

[51] Int. Cl.[3] ..... D06M 13/38; D06M 13/46

[52] U.S. Cl. ..... 252/8.8; 252/8.6

[58] Field of Search ..... 252/8.8

[56] References Cited

U.S. PATENT DOCUMENTS

| | | | |
|---|---|---|---|
| 3,554,784 | 1/1971 | Lyness | 252/8.8 |
| 4,014,800 | 3/1977 | Kleber | 252/8.8 |
| 4,309,510 | 1/1982 | Kleber | 252/8.8 |
| 4,322,302 | 3/1982 | Kleber et al. | 252/8.8 |

*Primary Examiner*—Maria Parrish Tungol

*Attorney, Agent, or Firm*—Connolly and Hutz

[57] ABSTRACT

Dressing agents for synthetic fibers, which contain an amine oxide of the formula

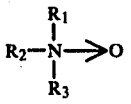

(1)

in which $R_1$ denotes $C_5$–$C_{22}$ alkyl or $C_5$–$C_{22}$ alkenyl, $R_2$ denotes a group of the formula

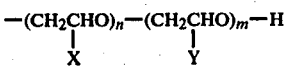

(2)

$R_3$ denotes $C_5$–$C_{22}$ alkyl, $C_5$–$C_{22}$ alkenyl or a group of the formula 2, either X denotes methyl and Y denotes hydrogen or X denotes hydrogen and Y denotes methyl, and n and m denote numbers from 2 to 8, it being necessary that the total of n and m does not exceed 10.

6 Claims, No Drawings

DRESSING AGENTS FOR SYNTHETIC FIBERS AND THEIR USE

It is already known from German Patent Specification No. 2,326,966 to employ amine oxides containing polyethylene oxide groups in preparation agents for synthetic fibers. However, in the course of developing recent processes for texturizing synthetic fibers, a requirement arises that the preparation agents themselves should be heat stable, that is to say sparingly volatile, and, in addition, should not decompose in stretching processes or in the stretch-texturizing process, that is to say in a short-term contact with heat, and that preparation residues which have been rubbed off or scraped off or have dripped off should not produce cracked products, carbonization or tarry residues on the heating units, stretching godets, fixing equipment or heaters for texturizing equipment. These tarry carbonization residues can, in fact, lead to damage of the dressed threads and can cause capillary breaks or thread breaks. It is a particular problem to find, for such preparation agents, non-carbonizing antistatic agents which exhibit a satisfactory antistatic action in conjunction with the other constituents of the preparation agent. Although the amine oxides described in German Patent Specification No. 2,326,966 are heat stable, it has been found that they form the tarry carbonization residues mentioned above when exposed to heat for a prolonged period.

The need has therefore arisen, to develop antistatic agents which are themselves heat stable, mix readily with the components of the slip agent and do not form tarry carbonization residues when heated at high temperatures for a prolonged period.

It has now been found that these conditions are fulfilled by oxalkylated amine oxides which do not contain a polyethylene oxide chain on its own, but a mixed ethylene and propylene oxide chain.

The invention relates, therefore, to a preparation agent for synthetic fibers which contains an amine oxide of the formula 1

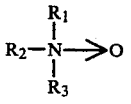

(1)

in which $R_1$ denotes $C_5$–$C_{22}$ alkyl, preferably $C_{10}$–$C_{16}$ alkyl, or denotes $C_5$–$C_{22}$ alkenyl, preferably $C_{10}$–$C_{16}$ alkenyl, $R_2$ denotes a group of the formula 2

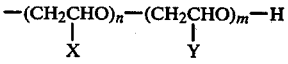

(2)

$R_3$ denotes $C_5$–$C_{22}$ alkyl, preferably $C_{10}$–$C_{16}$ alkyl, $C_5$–$C_{22}$ alkenyl, preferably $C_{10}$–$C_{16}$ alkenyl, or a group of the formula 2, either X denotes methyl and Y denotes hydrogen or X denotes hydrogen and Y denotes methyl, and n and m denote numbers from 2 to 8, it being necessary that the total of n and m does not exceed 10.

Within the definitions indicated above, the groups $R_1$, $R_2$ and $R_3$ are selected in such a way that the amine oxide is soluble in water. Preferred amine oxides are, inter alia, the following:

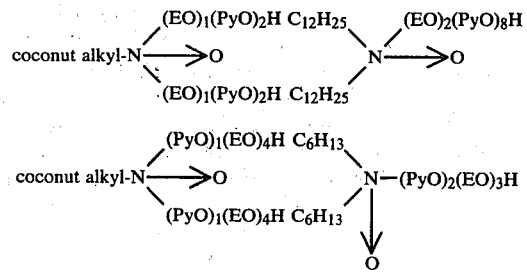

The preparation of these amine oxides is effected in accordance with known processes by oxalkylating monoalkylamines or dialkylamines, followed by oxidation with, say, hydrogen peroxide. The oxalkylation can be carried out by a process in which an addition reaction is carried out first with ethylene oxide and then with propylene oxide, or conversely. Products containing blocks of oxypropylene and oxyethylene units are then obtained. However, it is also possible to oxalkylate the amine using a mixture of ethylene oxide and propylene oxide of varying composition. As is known, this gives compounds containing polyoxyalkyl groups in which the oxypropylene and oxyethylene units are statistically distributed in accordance with the ratio of ethylene oxide to propylene oxide.

In the case of the monoalkylamines or dialkylamines, instead of alkyl compounds having a uniform chain it is also possible in every case to use compounds in which the alkyl groups represent technical fractions in which the average number of C atoms corresponds to or approximates to the abovementioned alkyl radicals. The alkyl radicals derived from natural, long-chain fatty acids are particularly preferred, since the corresponding tertiary amines containing one or two long-chain alkyl radicals are available commercially and the amine oxides are thus readily accessible (or are also commercially available). Since these natural fatty alkyl radicals frequently contain varying quantities of unsaturated components, the formula 1 also covers the corresponding alkenylamine oxides, as well as the alkylamine oxides.

The numerical values n and m are generally average figures, since the industrial oxalkylation process generally gives mixtures of products. This also applies to the oxethylates listed here - formulated as single substances for the sake of simplicity.

These amine oxides are used in preparation agents for synthetic fibers such as, say, polyester, polyamide, polyacrylonitrile or polyolefin fibers. Such preparation agents are usually composed of 0–50% by weight of oils, such as ester oils or mineral oils, 0–60% by weight of an emulsifier, such as, for example, oxethylated fatty alcohols, 0–60% by weight of a slip agent, such as, for example, water-soluble oxethylates containing terminal groups, ethylene oxide/propylene oxide copolymers or ethers thereof with fatty alcohols, 0–30% by weight of an antistatic agent, such as, for example, esters formed from $P_2O_5$ and fatty alcohols or oxethylated fatty alcohols, and also 1 to 50, preferably 5–20, % by weight of one or more of the amine oxides described above.

Even at a relatively low dosage, the amine oxides exhibit a high antistatic action. The quantities it is necessary to employ vary, depending on the nature and quantity of the remaining components (oil or emulsifier), and can be determined readily by means of simple preliminary trials. Usually, 0.01 to 2%, preferably 0.05 to 1%, relative to the weight of the substrate, is applied.

The low volatility of these compounds should be singled out, as should their distinctly reduced tendency to carbonization. Their good heat stability and low tendency to carbonization are evident from the following test in which 1 g of each of the compounds described in the following text was heated at 220° C. The percentage volatility and the yellowing were then determined in accordance with DIN 6162.

(a) Products in accordance with the invention

1. 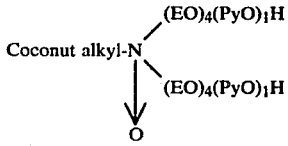

2. 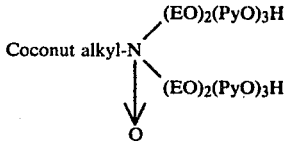

3. 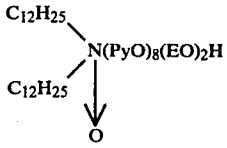

4. 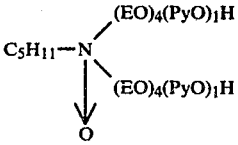

5. 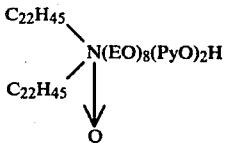

(b) Comparison in accordance with German Patent Specification No. 2,326,966

1. Coconut dimethylamine oxide

2. 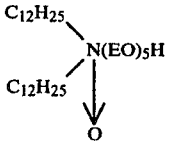

| | Volatility after 1 hour | Yellowing | Volatility after 24 hours | Yellowing (iodine color No.) |
|---|---|---|---|---|
| In accordance with the invention; a: | | | | |
| 1 | 4% | 400 | 91% | 400 |
| 2 | 5% | 300 | 93% | 300 |
| 3 | 6% | 300 | 94% | 300 |
| 4 | 7% | 500 | 97% | 500 |
| 5 | 2% | 200 | 90% | 200 |
| Comparison; | | | | |

-continued

| | Volatility after 1 hour | Yellowing | Volatility after 24 hours | Yellowing (iodine color No.) |
|---|---|---|---|---|
| b: | | | | |
| 1 | 11% | >1,100 | 80% | >1,100 |
| 2 | 10% | >1,100 | 85% | >1,100 |

Similarly good effects are produced by the following compounds:

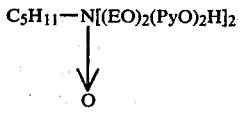

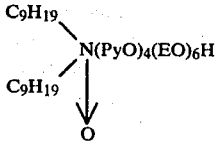

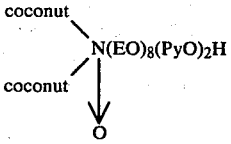

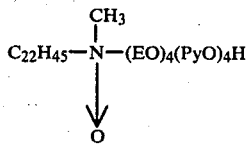

The examples which follow describe the composition of a few preparation agents according to the invention containing an amine oxide of the formula 1. The percentages are percentages by weight.

EXAMPLE 1

40% of butyl stearate (ester oil),

50% of oleyl alcohol containing 5 ethylene oxide units (EO) (emulsifier) and

10% of the compound of the formula

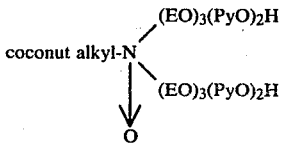

EXAMPLE 2

40% of coconut alkyl—O—$(CH_2CH_2O)_5CH_3$ (slip agent),

30% of stearyl alcohol containing 8 EO (emulsifier),

5% of the potassium salt of the $P_2O_5$ ester formed from lauryl alcohol (antistatic agent) and 25% of the compound of the formula

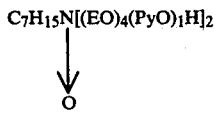

EXAMPLE 3

70% of mineral oil (viscosity 100 mPas at 20° C.), 25% of i—$C_{13}H_{27}$—$(EO)_8H$ (emulsifier) and 5% of the compound of the formula

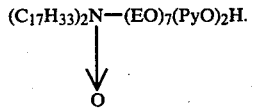

I claim:

1. A preparation composition for synthetic fibers which contains 1 to 50 percent by weight of an amide oxide of the formula 1

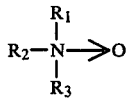

(1)

in which $R_1$ denotes $C_5$–$C_{22}$ alkyl or methyl or $C_5$–$C_{22}$ alkenyl, $R_2$ denotes a group of the formula 2

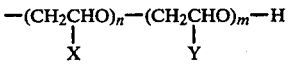

(2)

$R_3$ denotes $C_5$–$C_{22}$ alkyl, $C_5$–$C_{22}$ alkenyl or a group of the formula 2, either X denotes methyl and Y denotes hydrogen or X denotes hydrogen and Y denotes methyl, n denotes numbers from 2 to 8, and m denotes numbers from 1 to 8, it being necessary that the total of n and m does not exceed 10.

2. A preparation composition as claimed in claim 1, which contains an aminde oxide of the formula 1 in which $R_1$ and $R_2$ denotes $C_{10}$–$C_{16}$ alkyl or $C_{10}$–$C_{16}$ alkenyl.

3. Process for the preparation of synthetic fibers which comprises applying onto the fibers a preparation composition of claim 1.

4. A preparation composition as claimed in claim 1 which consists essentially of 0 to 50% by weight of an oil, 0 to 60% of an emulsifier, 0 to 60% by weight of a water-soluble oxyethylate slip agent, 0 to 30% by weight of an anntistatic agent and 1 to 50% by weight of at least one amine oxide of the said formula 1.

5. A preparation composition as claimed in claim 1 which comprises:

1–50% by weight of at least one amine oxide of said formula 1, an effective amount, up to 60% by weight, of an emulsifier;

the balance of the composition of the preparation agent comprising an ester oil, a mineral oil, a water-soluble oxyethylate slip agent, or an antistatic agent.

6. A preparation composition for synthetic fibers which contains 1 to 50 percent by weight of an amine oxide of the formula 1

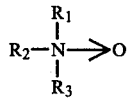

(1)

in which $R_1$ denotes methyl, $R_2$ denotes a group of the formula 2

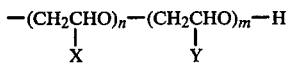

(2)

$R_3$ denotes $C_5$–$C_{22}$ alkyl, $C_5$–$C_{22}$ alkenyl or a group of the formula 2, either X denotes methyl and Y denotes hydrogen or X denotes hydrogen and Y denotes methyl, n denotes numbers from 2 to 8, and m denotes numbers from 1 to 8, it being necessary that the total of n and m does not exceed 10.

* * * * *

UNITED STATES PATENT AND TRADEMARK OFFICE

CERTIFICATE OF CORRECTION

PATENT NO. : 4,428,846

DATED : January 31, 1984

INVENTOR(S) : Kleber et al

It is certified that error appears in the above-identified patent and that said Letters Patent is hereby corrected as shown below:

In claim 1, second line (column 5, line 22), "amide" should read -- amine --.

In claim 2, second line (column 5, line 44), "aminde" should read --amine--.

Signed and Sealed this

*Seventeenth* Day of *July 1984*

[SEAL]

*Attest:*

GERALD J. MOSSINGHOFF

*Attesting Officer*

*Commissioner of Patents and Trademarks*